United States Patent [19]

Beusing

[11] 4,137,620

[45] Feb. 6, 1979

[54] APPARATUS FOR CONNECTING A COVER BAND TO GUIDE BLADING OF A TURBOMACHINE

[76] Inventor: Julius Beusing, Baden, Switzerland

[21] Appl. No.: 842,362

[22] Filed: Oct. 14, 1977 (Under 37 CFR 1.47)

[30] Foreign Application Priority Data

Oct. 14, 1976 [CH] Switzerland ..... 12984/76

[51] Int. Cl.[2] ..... B23P 11/00

[52] U.S. Cl. ..... 29/243.53

[58] Field of Search ..... 29/243.53, 243.54, 243.55; 72/447, 446

[56] References Cited

U.S. PATENT DOCUMENTS 2,513,780 7/1950 Baxter ..... 29/243.53

3,911,555 10/1975 Allen et al. ..... 29/243.54

*Primary Examiner*—James L. Jones, Jr.

*Attorney, Agent, or Firm*—Burns, Doane, Swecker & Mathis

[57] ABSTRACT

A riveting machine for connecting semi-cylindrical cover bands to the head ends of guide blading provided with rivet spigots at any point within a blade-carrying semi-cylindrical turbine component includes a radially adjustable riveting arm mounted for rotation within a plane normal to the cylinder axis about a pivot axis coaxial with that of the cylinder, and a riveting group carried at the outer end of the arm which comprises a rotatable riveting spindle and associated mechanism for pressing the cover band firmly against the head ends of the rigidly held guide blading while the rotatable riveting spindle works a head onto the spigot.

8 Claims, 2 Drawing Figures

APPARATUS FOR CONNECTING A COVER BAND TO GUIDE BLADING OF A TURBOMACHINE

FIELD OF THE INVENTION

The present invention relates to an improved apparatus for obtaining a durable connection between guide blading on a blade-carrying semi-cylindrical component of an axial flow type turbo-machine and a semi-cylindrical cover band which is secured to the heads of the guide blading by a riveting operation.

BACKGROUND OF THE INVENTION

Durable connections between guide blading and cover bands therefor are accomplished in many instances by hot or cold riveting. In both cases, the riveting process can be carried out by means of a hammering or rolling operation. It is known to use stationary riveting machines for either procedure, and mobile riveting apparatus can be used for applying the hammering technique.

A high-quality riveted joint can be accomplished by the known radial riveting method, a method that is similar to cold extrusion molding but it requires the use of special machines in view of the special operational requirements. This means that the objects to be riveted together, in the present case, guide blade carrying turbine semi-cylindrical components and their cover bands, must be fed into the radial riveting machine. Since modern, large-sized turbine cylinders cannot be readily moved in this manner, a manual riveting technique is being used in most cases. This manual riveting operation by means of a hammer, and possibly involving also a heating operation, requires great skill, aptitude and experience for accomplishing a properly riveted joint. The expenditure of time, and also the annoying noise level are relatively high in comparison with the mechanical radial riveting method. Furthermore, the riveted joints so produced will be of a diverse quality, and there will always be the danger of hidden deficiencies, such as crack formations, insufficient filling of rivet holes and stresses within the material, especially in the case of hot-riveting.

SUMMARY OF INVENTION

The principal objective of the present invention is to provide an improved and more economic riveting apparatus that makes it feasible to mechanically connect cover bands to the head ends of the guide blading at any point within the blade-carrying semi-cylindrical turbine component.

The invention solves the problems previously existing in that the riveting machine includes a readily adjustable riveting arm which is mounted for rotation within a plane normal to the cylinder axis about a pivot axis coaxial with that of the cylinder, and a riveting group carried at the outer end of the arm which comprises a rotatable riveting spindle and associated mechanism for pressing the cover band firmly against the head ends of the rigidly held guide blading while the riveting action between these two parts is taking place.

The invention offers the primary advantages that the riveting machine will provide greater work economy due to the precise, mechanical positioning of the rotatable and axially displaceable riveting spindle. Furthermore, the riveting machine is capable of being operated in a simple manner by semi-skilled personnel thus eliminating the need for use of highly skilled workers.

It will be particularly advantageous to operate the riveting spindle in accordance with the radial cold riveting method because this will now make possible the preparation of high-quality riveted joints, resulting from the radial riveting method, in the interior of the cylinders, work areas which could not be reached by prior known standard riveting machines.

It will be expedient to support the radially movable riveting arm by means of a pivot mounting, making it adjustable in a continuous, i.e. stepless manner over a range of 180° from a horizontal line. It will also be helpful if the pivotal mounting includes adjustability in a stepless manner in the axial direction of the semi-cylindrical guide blade carrying turbine component, this being accomplished by means of an axially guided carriage on which the pivot mounting for the riveting arm is supported. The improved arrangement thus makes it possible to carry out the cover band-to-guide blading riveting operation by utilizing one and the same riveting machine regardless of the diameter and length of the turbine cylinder involved.

In the case of a preferred embodiment, the mechanism for pressing the cover band against the heads of the guide blading includes a cylindrical jacket arranged co-axially with and surrounding the riveting spindle, and which is provided with piston components in common with the spindle serving to control the axial feed motions of the riveting spindle and cover band pressing mechanism towards and away from the rivet head and cover band respectively.

It will also be advisable to equip the cover band pressing mechanism with a hold-down in the form of a press pad which is applied against the surface of the cover band which in turn exerts a force against the head end of the guide blading, the latter being provided with rivet spigots which project through holes provided in the cover band. A hold-down mechanism of this type ensures the essential full seating of the cover band at the head of the blading in that the contact surfaces of the press pad become engaged in close proximity to the rivet spigot. Furthermore, the mounting of the riveting spindle within the hold-down mechanism will permit a full absorption of the shearing forces which arise during the radial riveting operation so that there will be no need for additional supporting means.

BRIEF DESCRIPTION OF THE DRAWINGS

In the accompanying drawings which illustrate a preferred embodiment of the improved riveting machine in a somewhat simplified manner but which illustrate fully the novel principles involved in the machine structure:

FIG. 1 is a somewhat diagrammatic view in elevation of the improved riveting machine in association with a semi-cylindrical guide blade carrying turbine component for riveting a semi-cylindrical cover band thereto.

Figure 2:
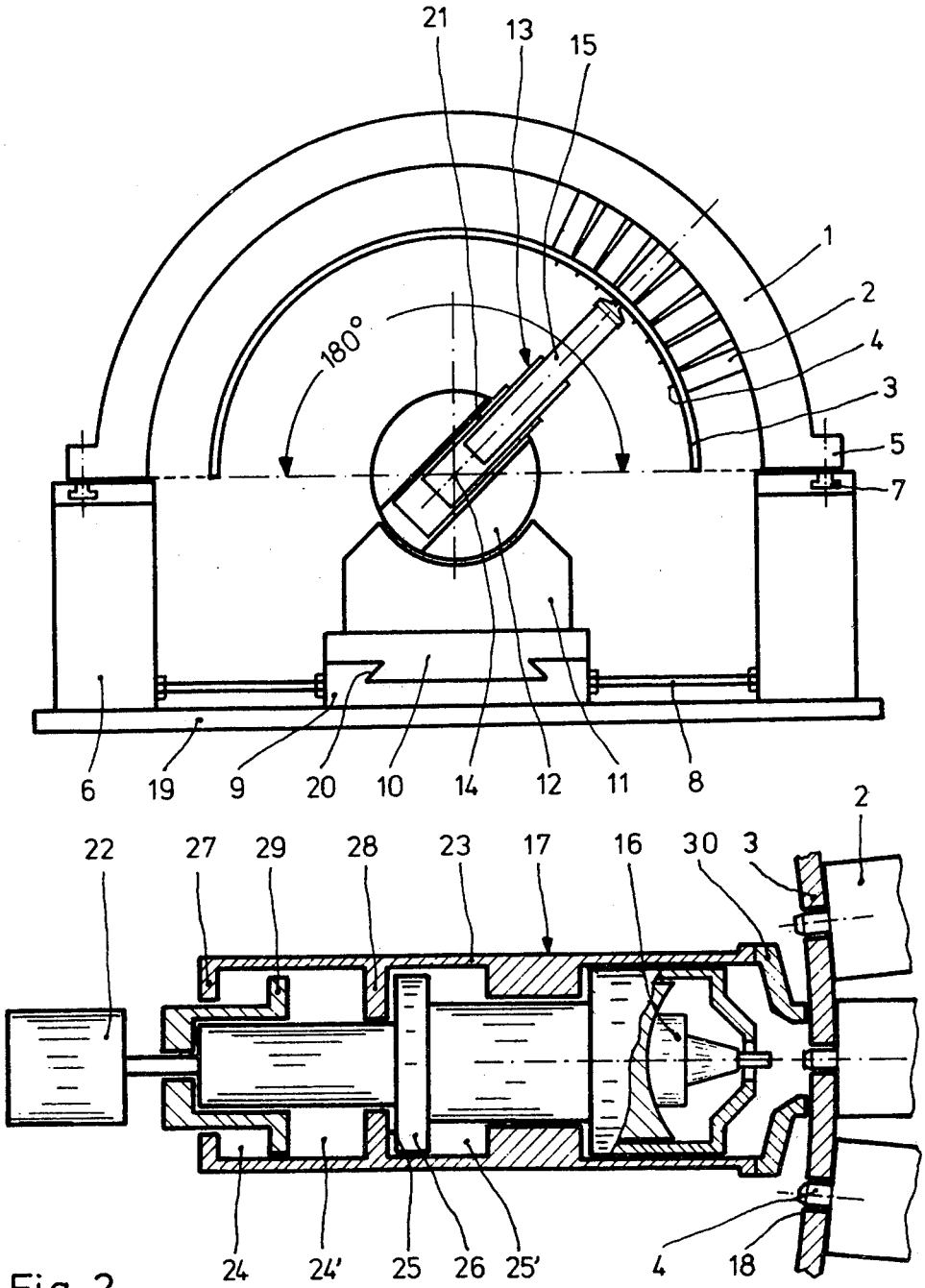
FIG. 2 is a longitudinal sectional view at a larger scale of the radially adjustable combined riveting and cover band hold-down mechanism carried by the pivotally mounted rivet arm.

Components which are immaterial insofar as the invention is concerned, such as drives and controls, have not been illustrated since these can be conventional and may take different modes.

DETAILED DESCRIPTION OF PREFERRED EMBODIMENT

With reference now to the drawings, a semi-cylindrical component 1 of a turbo-machine is seen to be provided with guide blading 2. The semi-cylindrical cover band 3 to be riveted to the head ends of the guide blading is provided with apertures 18 through which project rivet spigots 4 integral with the blading. The semi-cylindrical guide blade carrying component 1 rests with its diametral surface portions upon upstanding fixtures 6 on base plate 19 and is secured to the fixtures by way of fastening bolts, not specifically shown, which extend through flange portions into T-shaped slots located at the upper ends of the fixtures 6. Normally four such fixtures 6 and attachments are used for fastening the semi-cylindrical guide blade carrier 1 firmly in place on base plate 19. The fixtures 6 are adjustable along the base plate by means of T-slots, not illustrated, to different distances apart so that the riveting machine can accommodate semi-cylindrical guide blade carrying turbo-machine components of different diameters. Central alignment of the fixtures 6 relative to the riveting machine mounted between them is accomplished by means of adjustable screw spindles 8 which extend between fixtures 6 and carriage bed 9 of the machine which is fastened firmly in place on base plate 19, the fastening being accomplished by any suitable, non-illustrated clamping arrangement. Base plate 19 and carriage bed 9 are so dimensioned in the direction of the axis of the semi-cylindrical turbine component 1 that they are capable of accommodating and processing any required length of the latter.

A platen 10 connected to the carriage bed 9 by means of the usual dove-tail guide 20 or an equivalent in the form of a flat, prismatic or roller type guide serves as a mount for the riveting mechanism which can thus be moved axially within the semi-cylindrical guide blade carrying structure so as to be able to rivet the different rows of blading provided within the same. This riveting mechanism includes a control housing 11, a pivot mounting 12 atop the control housing and a rivet arm 13 supported by the pivot mounting 12 and which extends in a radial direction from the pivot axis 14. The height of the upstanding fixtures 6 is dimensioned in such manner that the rotational axis 14 of the pivot mounting 12 coincides with the axis of the semi-cylindrical guide blade carrier 1 which rests upon these fixtures.

The pivot mounting 12 includes a turning plate which is mounted on both sides and which carries a receptacle for the rivet arm 13. The rivet arm 13 and the turning plate are infinitely variable, i.e. in a stepless manner, by not illustrated hydraulic servo-drives located in the control housing 11, and the pivot mounting 12 is designed in such manner that the pivot arm 13 is capable of performing a rotational movement spanning 180° from the horizontal line, as indicated in FIG. 1, thus making it possible to reach all rivet spigots 4 on the guide blading 2. Since a very accurate positioning of rivet arm 13 is essential, an infinitely variable rotational adjustment of the mounting turning plate can be accomplished by use of a self-locking reduction worm gear drive. It will be expedient to protect the 180° horizontal limit positions of rivot arm 13 by means of electrical circuit breakers in a known, but not illustrated manner.

Within control housing 11 there are further located, not illustrated servo mechanisms which supply pressurized oil for operation of the riveting group 15 mounted at the outer end of rivet arm 13. The latter is connected mechanically with the turning plate of the pivot mounting 12. It serves to actuate the riveting group 15 along a semi-circular path and sets the starting position for the riveting operation. In order to make it possible to cover any operating range, determined by the smallest and largest diameters of the guide blade carriers being processed, the rivet arm 13 is designed in such manner that it can be adjusted. It consists of several, schematically illustrated, telescoped components 21 which can be extended or retracted synchronously, for example, by means of a non-illustrated worm-gear spindle. The inner telescopic part is equipped with a receptacle for mounting the riveting group 15 and also accommodates the necessary pressurized oil feed lines for actuating the riveting group.

The riveting group 15 is illustrated at a larger scale in FIG. 2 from which it will be seen that it comprises a riveting spindle 16 and the cover band pressing and hold-down mechanism 17. The riveting spindle operates in accordance with the known radial cold-riveting method and is driven by a motor 22 actuated by pressurized oil. Spindle 16 is guided within a cylindrical jacket 23 of the hold-down mechanism 17 and has, in common with the latter, a piston chamber 25, 25'. Piston 26 which is located in this chamber and is attached to spindle 16 controls the riveting spindle motion. The latter forms also one part of the inner boundary of piston chamber 24, 24' within which the feeding motion of the hold-down mechanism 17 takes place. For this purpose, jacket 23 is provided with pistons 27 and 28. A stationary piston 29 forms an additional boundary for the piston chamber. A cover band press pad 30 is secured to the outer end of jacket 23 by means, not illustrated, and includes a central opening through which the riveting spindle 16 can pass for working the heads of the rivet spigots 4 to secure the cover band 3 to the head ends of the guide blading 2.

The shaping of press pad 30 is based upon the requirement that the cover band 3 be forcefully pressed against the blading 2 and also be able to absorb shearing forces which arise during the radial riveting operation. The first requirement is important because the cover bands are usually made from rolled profile stock and therefore have bending resilience. The cover bands when placed onto the rivet spigots 4 will for this reason fail to make close contact with the heads of the blading 2 unless they are firmly braced. It is also the function of the hold-down mechanism 17 to support the riveting group 15 together with the rivet arm 13 by clamping the units between the cover band 3 and the turning plate of the pivot mounting 12.

Before explaining the method of operation of the riveting machine it needs to be stated that all steps involved in the method are carried out preferably by electro-hydraulic mechanisms. Within the machine proper, the operational steps are performed mostly by mechanical means, i.e. by means of gearings. Axial movement of platen 10 on which the machine is mounted, as well as rotary movement of the pivot mounting 12 are controlled by means of hydraulic servo motors. Upon reaching their proper positions, these units are held in place by hydraulic clamping.

The guide blade carrying semi-cylinder 1 shown in FIG. 1 is assumed to be properly aligned and fastened on the fixtures 6. The riveting machine is then moved by carriage bed 9 and platen 10 into the initial axial position which means that the rivet spindle 16 is moved into the plane of the rivet spigots 4 of a row of blading 2 to be riveted to the cover band. Following this positioning, the platen 10 is rigidly fastened to the stationary carriage base 9 by means of non-illustrated gripping ledges so that the forces which arise during the riveting operation will not place a stress on the carriage guides.

The riveting group 15 is then brought into the initial radial position by means of the telescoped parts 21 of rivet arm 13, which means that the frontal area of press pad 30 is moved until its distance from the internal surface of cover band 3 is approximately 10 mm. The riveting group 15 is now moved by way of its pivot mounting 12 so that the axis of riveting spindle 16 is aligned with that of a rivet spigot 4 to be worked. The turning plate of the pivot mounting 12 is then clamped down centrally.

The manner in which the hold-down mechanism 17 and riveting spindle 16 operate will now be explained in more detail on the basis of FIG. 2. When the adjustment of the riveting group 15 in relation to a rivet spigot 4 has been completed, piston chamber 24' is pressurized with oil. Piston 28 then moves the cover band hold-down mechanism 17 forward and press pad 30 forces the cover band 3 against the head of blading 2. The riveting machine is thus now positively coupled to the blade carrier 1 and a closed path of forces is created by the various mountings, to wit: the riveting machine/base plate, base plate/fixtures, and fixtures/blade carrier. This closed path of forces will become effective only if the power effect of the cover band hold-down mechanism 17 is greater than the pressure applied to the rivet spigot 4 by the riveting spindle 16. For this reason the hold-down function and riveting function are indpendently controlled. The riveting function is started by activating oil motor 22 causing spindle 16 to rotate. Piston chamber 25 is now oil pressurized and riveting spindle 16 is advanced by piston 26 to engage the end of the spigot 4 and will carry out the riveting operation which is known per se. It consists primarily of a radial rolling out of the end of the spigot transforming it into a rivet head by use of a steady axial force of up to 3.5 tons. The preciseness and uniformity of the height of all rivet heads attained by this mechanical riveting method makes it feasible to arrange later on an additional sealing strip at the cover band, thus increasing the degree of efficiency of the blading. Furthermore, the quality of the riveted joint is substantially improved in comparison with a joint produced by manual hammering because the radial riveting method preserves the structure of the rivet head material.

When the riveting operation has been completed, piston chamber 25' is oil pressurized, the riveting spindle 16 is returned to its initial position and oil motor 22 is cut off. Piston chamber 24 is now oil pressurized and piston 27 returns the cover band hold-down mechanism 17 to its initial position, thereby breaking the closed force path. The lock on pivot mounting 12 is then released and the riveting machine can then be moved to the next riveting position.

In conclusion, the inventive concept as defined in the appended claims is obviously not limited to the specific embodiment which has been described. It is possible, for example, to install the riveting group 15 on a mobile base in lieu of the locally fastened carriage guide as illustrated by FIG. 1. A solution of this type results in a riveting machine of extremely great mobility and almost unlimited possibilities of practical use. It is also obvious that the pivot mounting 12 and the rivet arm 13 secured thereto are not limited to the specific embodiments illustrated, and that all known solutions relating to the production of linear and rotary movements do not exceed the scope of the invention.

I claim:

1. A riveting machine for connecting semi-cylindrical cover bands to the head ends of guide blading provided with rivet spigots at any point within a blade-carrying semi-cylindrical turbine component which comprises a radially adjustable riveting arm mounted for rotation within a plane normal to the cylinder axis about a pivot axis coaxial with that of the cylinder, and a riveting group carried at the outer end of said arm, said riveting group including a rotatable riveting spindle engageable with the end of the spigot and an associated mechanism for pressing said cover band against the head ends of said guide blading while said rotatable riveting spindle works a head onto the spigot.

2. A riveting machine as defined in claim 1 wherein said riveting spindle operates in accordance with a radial cold-rivet method.

3. A riveting machine as defined in claim 1 wherein the pivot mounting for said riveting arm is adjustable in a stepless manner over a range of 180° from a horizontal line.

4. A riveting machine as defined in claim 1 and which further includes means supporting said riveting arm and its pivotal mounting for movement in the direction of the axis of said semi-cylinder.

5. A riveting machine as defined in claim 1 wherein said mechanism included in said riveting group for pressing said cover band against the head ends of said guide blading comprises a cylindrical jacket coaxially surrounding said riveting spindle and which is provided with a press pad engageable with the head ends of the guide blading.

6. A riveting machine as defined in claim 5 and wherein said press pad includes a central opening through which said riveting spindle passes to engage the end of each rivet spigot which projects through an opening in said cover band.

7. A riveting machine as defined in claim 5 wherein said cylindrical jacket together with said riveting spindle from pistons and piston chambers which serve to control axial feed motions of said spindle and jacket respectively toward and away from said rivet spigots and cover band respectively.

8. A riveting machine as defined in claim 1 and which further includes a base plate and upstanding fixtures thereon on which said blade-carrying semi-cylindrical turbine component is mounted, and wherein the pivotal mounting for said radially adjustable riveting arm is supported on said base plate between said fixtures for movement in the axial direction of said turbine component.

* * * * *